United States Patent [19]

Wentzel

[11] Patent Number: 4,569,383

[45] Date of Patent: Feb. 11, 1986

[54] SECTIONAL DOOR AND COMPONENTS THEREOF

[75] Inventor: Harold G. Wentzel, Union, Mich.

[73] Assignee: Uneek Cap and Door, Inc., Elkhart, Ind.

[21] Appl. No.: 616,853

[22] Filed: Jun. 4, 1984

[51] Int. Cl.[4] ..... E06B 3/12; E05D 15/22

[52] U.S. Cl. ..... 160/201; 160/229 R

[58] Field of Search ..... 160/201, 229 R; 52/202, 52/347, 368, 403; 49/397

[56] References Cited

U.S. PATENT DOCUMENTS

| | | | |
|---|---|---|---|
| 2,266,973 | 12/1941 | Horton | 52/397 |
| 2,280,389 | 4/1942 | Edwards | 52/403 |
| 3,178,776 | 4/1965 | Stansberry | 160/229 R |
| 3,212,140 | 10/1965 | Byrka | 49/397 |
| 3,334,681 | 8/1967 | Crosswell | 160/201 |
| 3,347,305 | 10/1967 | Urbanick | 160/201 |
| 3,693,693 | 9/1972 | Court | 160/201 |
| 4,006,569 | 2/1977 | Kain | 52/397 |
| 4,110,942 | 9/1978 | Slocomb | 52/397 |
| 4,119,133 | 10/1978 | Wolf | 160/201 |
| 4,187,657 | 2/1980 | Sukolic | 52/397 |
| 4,332,111 | 6/1982 | Terashima | 52/397 |
| 4,379,480 | 4/1983 | Kempel | 160/201 |
| 4,511,173 | 4/1985 | Wentzel | 160/201 |
| 4,532,973 | 8/1985 | De Falco | 160/201 |

*Primary Examiner*—Reinaldo P. Machado

*Attorney, Agent, or Firm*—Gordon W. Hueschen

[57] ABSTRACT

There is disclosed and overhead sectional door in which the framing sections are composed of tubular extrusions constructed to provide for a sealing bead about the periphery of the door which abuts the door frame and seals it against entry of dust and water. The door sections are hinged together by integral complementary male and female hinge sections and the outer framing members, that is the top and side framing members, are constructed with strategically placed screw receptors to facilitate making corners.

22 Claims, 7 Drawing Figures

Fig. 1
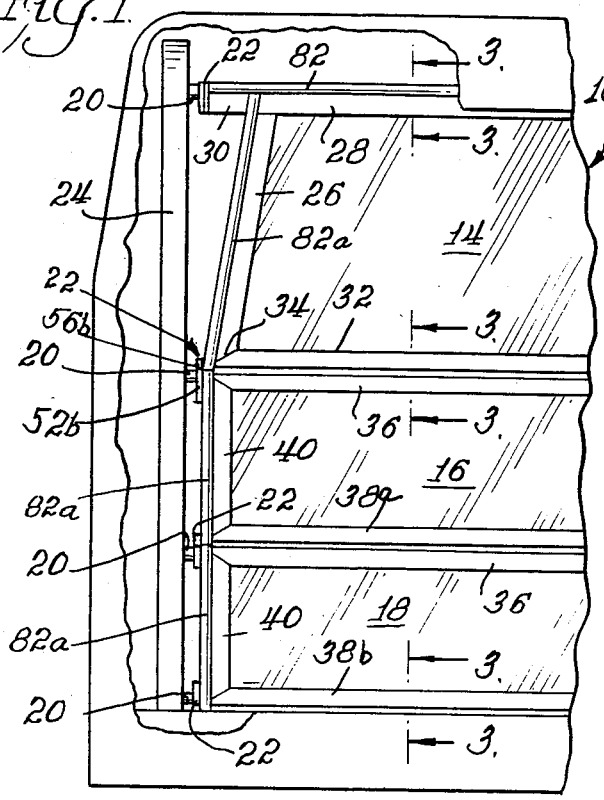
Fig. 2
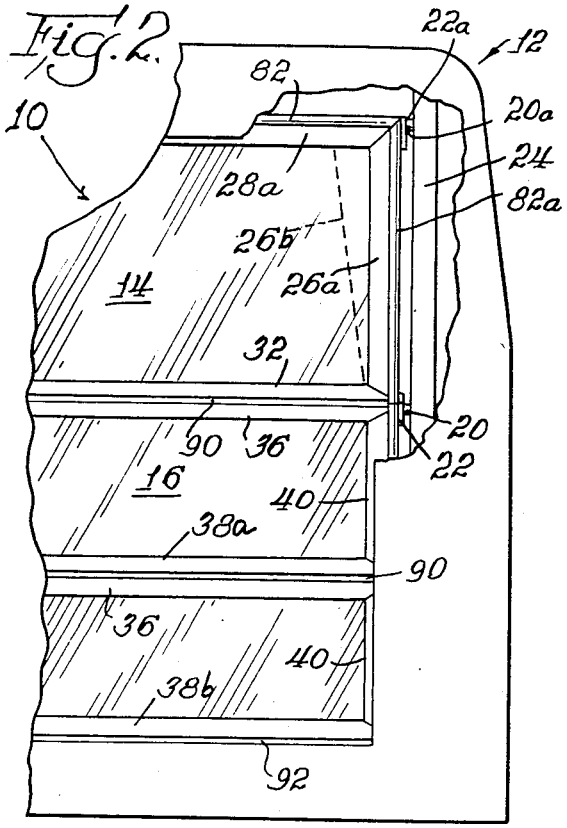
Fig. 7
Fig. 5
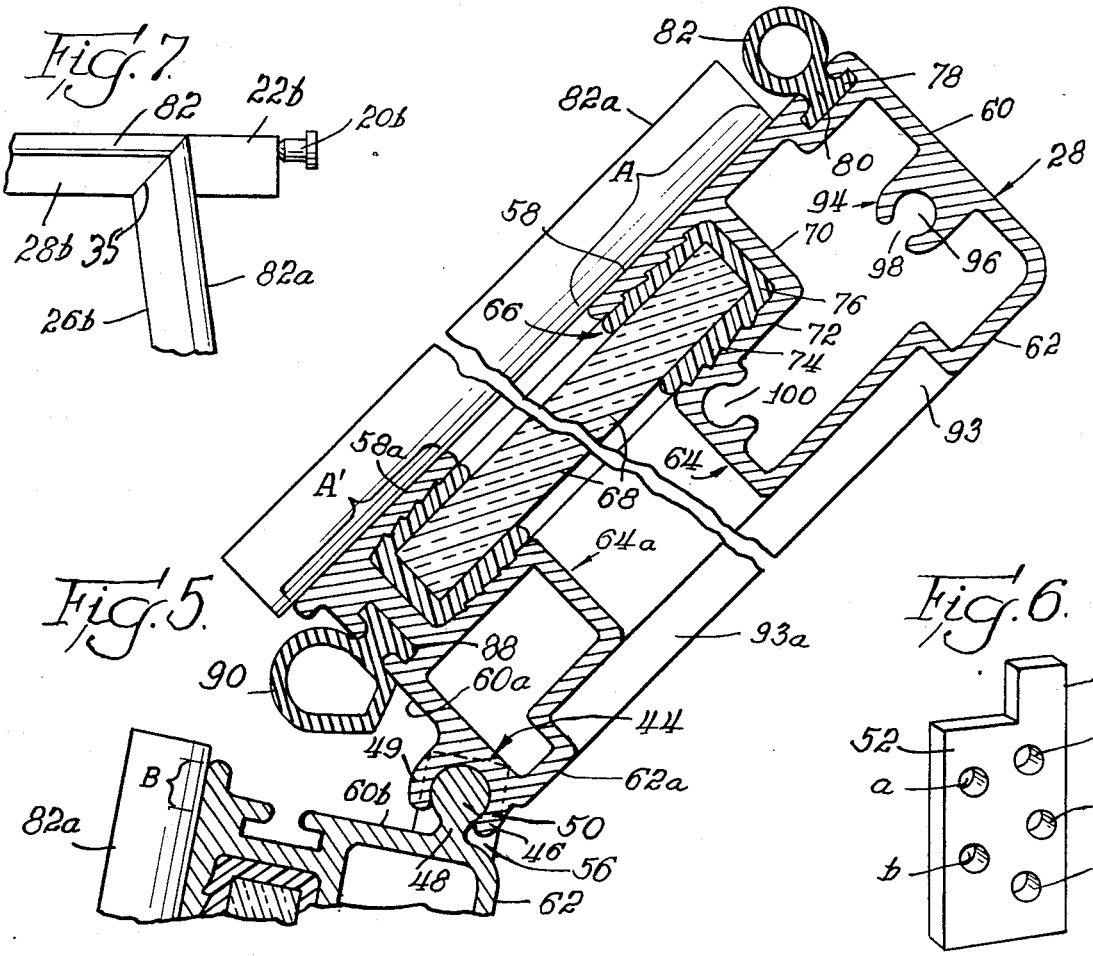
Fig. 6
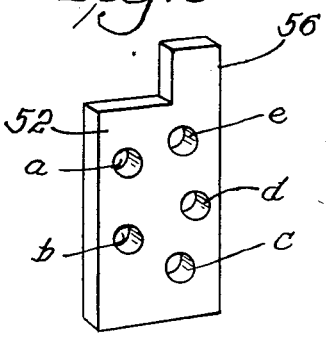

56a
82
78
20a
57
52a
A
58
22
24
30
28
82a
26
14
24
26
14
82a
A'
34
32
56b
84
22
B
90
42
36
20b
82a
52b
40
16
22
20c
82a
40
18
24
42
38
52c
B
92
4
82
78
60
28
56a
80
96
94
98
62
83
70
58
A
76
72
93
74
74
100
66
64
68
83
64a
93a
58a
85
32
A'
88
90
62a
82a
60a
44
56
84
49
50
B
43
46
48
36
60b
62
38a
93a
64a
83
64a
93a
38
62a
58a
88
60c
86
B
92
4

SECTIONAL DOOR AND COMPONENTS THEREOF

BACKGROUND OF THE INVENTION

The invention relates to a sectional door and to component members thereof.

FIELD OF THE INVENTION AND PRIOR ART

Overhead doors are commonly used as closures for garages and like buildings and for vans and like motor vehicles. Efforts heretofore directed to adaption of such overhead doors for caps for light pickup trucks has run into difficulty due to the problem of obtaining suitable light weight frame members for framing the door sections.

It has been proposed to make such frame members for door sections from extrusions of light material such as aluminum but it has been found difficult to obtain suitable water and dust-tight closures and to obtain such closures in which the hinge sections are free of trouble.

OBJECTS OF THE INVENTION

It is an object of the invention, therefore, to provide a new and useful overhead or sectional door suitable for use in small vehicles, for example, pickup trucks provided with caps. It is a particular object of the invention to provide such overhead or sectional doors which are extremely light weight and which are substantially tight against dust and water. It is a further object of the invention to provide such doors with improved hinge structure. Still other objects are to avoid the disadvantages of the prior art and to obtain such advantages as will appear as the description proceeds.

SUMMARY OF THE INVENTION

The invention relates to a sectional or overhead door and is particularly directed to a frame member therefor which comprises a hollow tubular extrusion essentially rectangular in cross section, having a front face, an outer side face, a rear face, and an inner side face, and a front panel-receiving channel indented in said inner side face adjacent the front face thereof, and an undercut receptor in the front face adapted to receive a complementary portion of a sealing bead, said receptor being located between said channel and the corner formed by said front face and said outer side face.

The invention may also include one or more further features in which said outer side face has a centrally-located protuberance on the inner side thereof which projects into the interior of said extrusion a distance approximately equal to the undercut receptor and has a longitudinal screw-receiving bore therein at a location such that said bore is removed from the outer side of said outer face a distance substantially equal to the diameter of said bore; and in which there is a second screw-receiving in the inside of the corner between said channel and said inner face.

The invention is also directed to a corner of a framing section of a sectional door comprising top and side members comprising frame members which are mitered together to form the corner, at least one of said frame members being a frame member as described above. Advantageously, one in which the second frame member comprises a second tubular extrusion having a front face, an outer side face, a rear face and an inner side face, said second extrusion having a panel receiving channel indented into said inner side face adjacent said front face and an undercut receptor for a sealing bead located in said outer side face opposite to said channel, the front face of said second extrusion being narrower than the front face of said first extrusion and said miter being cut on an angle determined by the relative widths of said faces.

The invention is also directed to a corner as described above in which a sealing bead is anchored in said undercut receptor by a complementarily shaped anchor strip which is cut away as needed to permit said bead to overlie the mitered part of said second extrusion.

The invention also relates to a corner of a framing section for an overhead door comprising top, bottom, and side frame members of which said top and side frame members are frame members according to the above-described first tubular extrusions, said top frame member being fastened to the tops of said side frame members in butt joints with the top frame member projecting beyond the tops of the side frame members and the side face members sloping downwardly and outwardly to the ends of the bottom frame member, advantageously, in which said bottom frame member has a front-panel-receiving channel therein complementary with the corresponding channels in the top and side frame members and a front face which is narrower than the front face of the top and side frame members and said side member being fastened thereto on a miter cut on an angle determined by the relative widths of said faces and the slope of said side members, whereby the inner edges of the front faces of the side front frame members coincide with the inner edge of the front face of the bottom frame member at the miter.

The invention also relates to a corner section for an overhead door which comprises sealing beads anchored in receptors of two like frame members joined in a corner by a miter by complementarily shaped anchor strips, said beads being cut on the same angle as said miter, whereby the bead of the top frame member abuts the beads of the side members at said miter.

The invention also relates to a corner in which a sealing bead is anchored in the undercut receptor of an extrusion by means of a complementarily shaped anchor strip, said strip being cut away as needed to permit said bead to overlie a second extrusion, advantageously, also, one in which sealing beads are anchored in said undercut receptors by means of complementarily shaped anchor strips and in which said strips of the sealing beads of the side frame members are cut away as needed to permit said beads to overlie the front of the top frame member and to abut the sealing bead anchored thereto, and, also advantageously, in which sealing beads are anchored in side frame members by means of complementarily shaped anchor strips which are cut off on said miter leaving said bead free to overlie the front face of the bottom frame member.

The invention also relates to sectional doors having frame members, corners and framing sections as described above.

The invention also relates to an overhead door, the framing of which comprises top, bottom, and side frame members formed of tubular extrusions hinged together by means of apposed transverse frame members which have complementary male and female hinge members adapted to slide one into the other and which are mitered to side frame members constructed according to claim 2, the side frame members which are mitered to the transverse member bearing the female hinge component having a plate member affixed thereto which has a lug that extends over the end of said female hinge component and inhibits lateral displacement of the male component therein, said plate overlying the portion of the outer side face from said protuberance to the rear face.

BRIEF DESCRIPTION OF THE DRAWINGS

In the drawings:

FIG. 1 is a partial face view with parts broken away of a sectional door according to the invention;

FIG. 2 is a partial face view with parts broken away of a modified form of a sectional door according to the invention;

FIG. 5 is a view according to FIG. 3, with the top section folded back;

FIG. 6 is an isometric view of a plate utilized as a end stopper for the hinged sections; and FIG. 7 is a face view of a modified corner according to the invention.

DESCRIPTION OF THE PREFERRED EMBODIMENTS

Figures 3, 4:
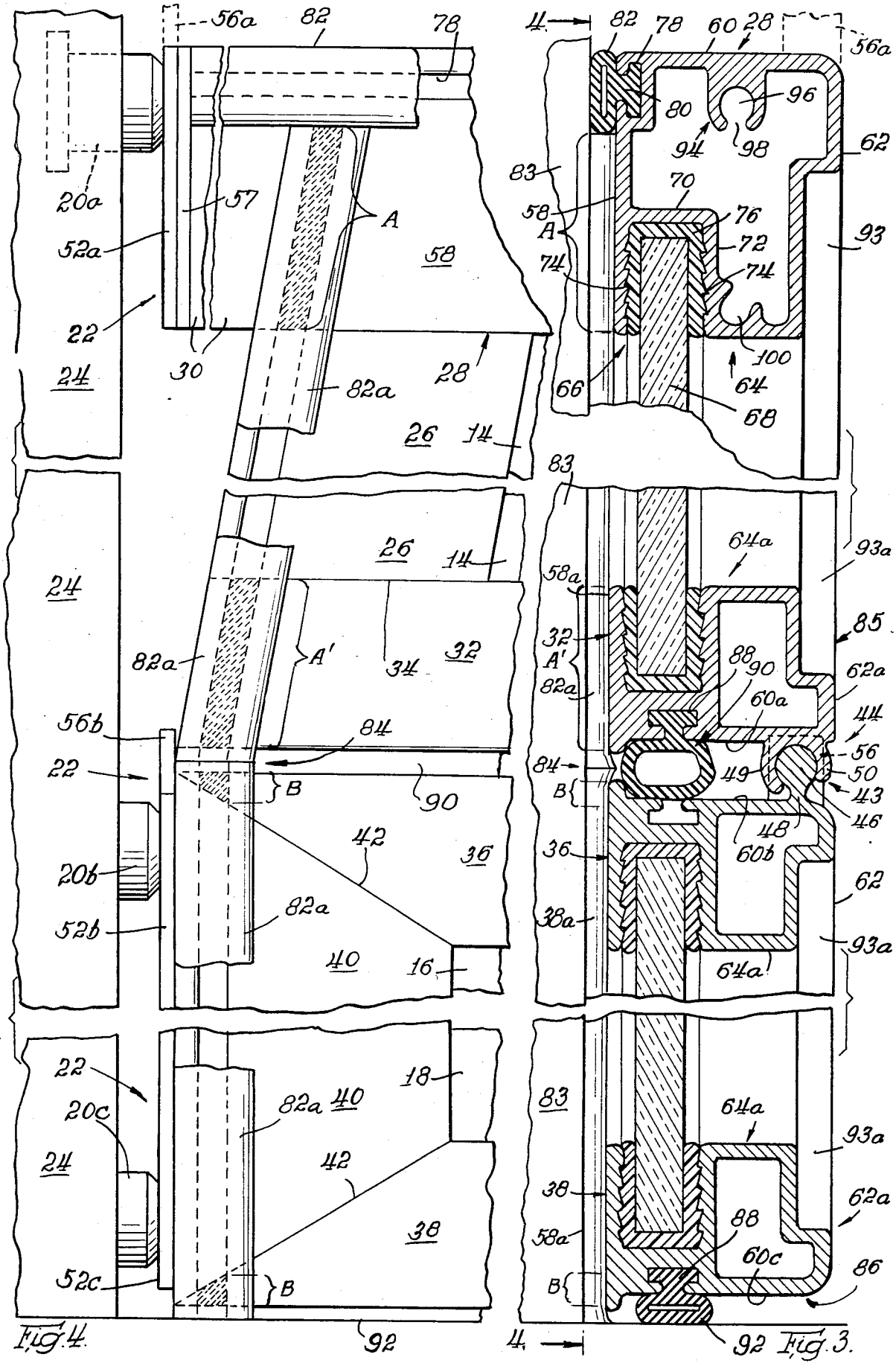
FIG. 3 is a cross section taken along line 3—3 of FIG. 1.
FIG. 4 is a detailed view of FIG. 1.

In the drawings, FIGS. 1 and 2 are face views of an overhead door 10 mounted in the rear of a capped pickup 12.

The overhead door 10 is comprised of a plurality of sections 14, 16, and 18, with the adjacent panels, for example, 14 and 16 and 16 and 18 hinged together. At the bottom of the bottom panel 18 and the top of the top panel 14 and panels 16 and 18, adjacent the hinged portions, are rollers 20 mounted on suitable brackets 22 attached to the door sections and mounted to roll in a suitable track 24.

In FIG. 1, the side frame member 26 of section 14 is attached to the top frame member 28 by a butt joint which is offset inwardly, leaving an extended portion 30 of the top frame member 28 extending out to the roller support 22. The side frame member 26 is attached to the bottom frame member 32 by a complementary butt joint 34.

If desired, the side frame member 26 can be fastened to the top frame member 28 and bottom member 32 by miter joints, as shown in FIG. 2, in a right angle as shown in solid lines, or in an obtuse angle 35, as shown in dotted lines in FIG. 7. The latter is particularly advantageous when the side frame member **26*b* is angled in, as shown in the dotted lines. A special mounting block 22*b* is required to bring the roller 20*b*** out to the track.

The intermediate frame section 16 and the bottom panel 18 have top transverse frame members 36 and bottom transverse frame members 38 connected by side frame members 40 with mitered joints, such as shown at 42 in FIG. 4. The mitered joints 42 are on an acute angle because the width of the side frame members 40 is greater than that of the top and bottom frame members 36 and 38.

The frame members between the sections, to wit, the bottom frame member 32 and top frame member 36 between sections 14 and 16, and the top frame member 36 and bottom frame member **38*a* between sections 16 and 18 are hinged together by complementary hinge components, as shown in FIGS. 3 and 5. These hinge components comprise a male member 43 and a female member 44. The male member comprises a cylindrical portion 46 attached to frame member 36, at or near the rear portion thereof, by narrow stem 48. The female member has a complementary shape to receive the cylindrical portion 46. The edges 49 and 50 are spaced apart sufficient to allow the desired hinge movement but insufficient to permit removal of the cylindrical portion radially. In assembly, the cylindrical portion 46 can be slid axially into the female portion 44. A plate 52 of the configuration shown in FIG. 6 can be used for the roller supports, as shown at 52 in FIG. 4 and in dotted lines in FIGS. 3 and 5, with the lug 56 projecting up over the end of the female hinge component 44 to inhibit lateral or axial movement of the male hinge component 43. This is needed especially when a miter joint 34 is replaced by a butt joint with the side frame members 26 and 40 abutting the bottom frame members 32 and 38. One of the advantages is that the portion of the side frame members 26 and 40 which extend down to the outer face of the transverse members 32 and 38 automatically block lateral displacement of the male component 43** of the hinge.

The plate 52 has a plurality of holes, a, b, c, d, and e therein. Holes e and c are used for mounting the rollers 20. The axle of the rollers are swaged into these holes or otherwise rigidly fastened therein and the plates, which can be right-handed or left handed according to which side is used, are mounted in the positions shown in FIGS. 1, 2, and 4. That mounted on panel 16 has the lug **56*b* extended up, as shown in FIG. 4, to block the hinge elements. In the top panel 14 there is interposed a face plate 57 to cover the open end of top member 28. It can be anchored in the screw-receiving bores 96 to 100, to be described later. The plate 52*a* is fastened to the face-plate 58 by suitable sheet metal screws not shown, threaded through any of holes a, b, c, or d. Hole e is used for mounting the roller 20*a*. The lug 56*a*** is shown in dotted lines to show that it is non-functional and can be cut off, if desired.

The plate **52*b* is mounted so that the lug 56*b* blocks the hinge element 49, as shown in dotted lines in FIG. 5. The roller 20*b***, in this case, is mounted in hole e.

The plate **52*c* has the rollers 20*c* mounted in hole c and is mounted so that the roller 20 is as near the bottom as possible. Here, too, the lug 56*c* (not shown) is non-functional. However, the configuration of the plate 52** is such that it can be used in all positions by mounting the axle of the roller in the appropriate hole. The holes a, b, and d are positioned so that at least two of them coincide with empty spaces in the extrusions.

The frame members are tubular extrusions made of aluminum or like extrudable material which have a front face 58 and **58*a*, an outer side face 60, 60*a*, 60*b*, and 60*c*, a rear face 62 and 62*a*, and an inner face 64 and 64*a***.

The top and side frame members, for example, 26, 28, and 40 have a cross section illustrated in the top part of FIG. 3. The inner side face 64 has a front panel-receiving channel 66 indented therein to receive the front panel 68. The front portion of channel 66 coincides with the front face 58 and has a bottom portion 70 parallel with the inner face 64 and a inner side 72 parallel with front face 58. The channel 66 has jagged teeth 74 on each side to engage a rubber or plastic filler 76 to secure the panel 68 in the channel. Adjacent the top of the front face 58 is an undercut acceptor 78 adapted to receive a complementary T-shaped anchor portion 80 of sealing bead 82 which anchor portion is complementary to the acceptor 78. In the open position of the door, the beading 82 assumes a tubular shape, as shown in FIG. 5 and in the closed position where it abuts the door frame 83, it is compressed into the flat shape shown in FIG. 3. Thus, an effective seal is maintained between the topmost of the frame members and the side frame members and the door frame, as can best be seen in FIG. 3.

Inasmuch as in the butt joints shown in FIG. 4, there is no undercut receptor available in the portion indicated by A and A', the T-shaped anchor member of beaded seal 82*a* is cut off in that portion to allow the beaded seal 82*a* to lap the outer side face 58 up to abutment with the beading 82. The overlapped portion of the beading 82*a* can be fastened to the outer side face 58 by adhesive.

Similarly, at the miter joint 42 in FIG. 4, a portion of the anchor strip of beading 82*a* is cut off, as shown at B, to allow the bead to overlap the portion of the outer side face 58*a* forming part of the miter joint. This allows the sealing bead 82*a* to extend down to a position where it abuts the next section beading, as shown at 84 in FIG. 3. There is thus obtained a sectional door having sealing bead along the top and down each side in position to abut the door frame 83 when the door is in closed position, as shown in FIG. 3.

One of the bottommost frame members, for example, 85, which has the hinge elements thereon, has in its outer side face 60*a* an undercut receptor 88 adapted to receive beaded sealing member 90 which has an egg-shaped cross section, as best seen in FIG. 5. This causes the bead when flattened, as shown in FIG. 3, to be squashed forward into the available space between the apposed frame sections. A similar beading construction is provided as shown at 92 in FIG. 3, in which the sealing bead abuts the bed of the truck and cooperates with the peripheral sealing beads to provide a water and dust tight door.

The egg-shaped sealing bead 90 can also be used in lieu of the tubular ones 82, if desired.

The extrusions have provided in their rear faces chamfers 93 and 93*a*. Chamfer 93 is longer than the chamfers 93*a* to accommodate for the mitering of two frame members having front faces of different widths.

The tubular extrusions which make up the outer frame members 26 and 40 have a projection 94 projecting inwardly into the tubular structure from outer side face 60. This protuberance has a cylindrical, screw-receiving channel 96 therein having a gap 98 in the bottom thereof to permit expansion when screws are driven into the screw-receiving channel 96.

The protuberance 94 is about twice as long as the diameter of the screw-receiving channel 96 and is centrally located between the inner surface of the rear face 62 and the inner surface of the acceptor 78. A like screw-receiving bore 100 is provided in a corner formed by the inner side face 64 and the wall 72 of the channel 66. The purpose of this structure is to provide means whereby corners can be formed either butt-jointed or mitered and fastened together with screws long enough to project into the screw-receiving channel 96.

There is thus provided an overhead sectional door in which the frame members thereof are composed of light extrusions having shapes and configurations such that they can be combined to form door sections which, in the closed position, have a sealing bead compressed against the door frame and which is provided with means to prevent lateral displacement of the male hinge component in the female hinge component.

It is to be understood that the invention is not to be limited to the exact details of construction, operation, or exact materials or embodiments shown and described, as various modifications and equivalents will be apparent to one skilled in the art, and the invention is therefore to be limited only by the full scope of the appended claims.

I claim:

1. A frame member for framing sections of a sectional door which comprises a hollow tubular extrusion essentially rectangular in cross section, having a front face, an outer side face, a rear face, and an inner side face, and a front panel-receiving channel indented in said inner side face adjacent the front face thereof, and an undercut receptor in the front face adapted to receive a complementary portion of a sealing bead, said receptor being located between said channel and the corner formed by said front face and said outer side face.

2. A frame member of claim 1, in which said outer side face has a centrally-located protuberance on the inner side thereof which projects into the interior of said extrusion a distance approximately equal to the undercut receptor and has a longitudinal screw-receiving bore therein at a location such that said bore is removed from the outer side of said outer face a distance substantially equal to the diameter of said bore.

3. A frame member of claim 1, in which there is a screw-receiving bore at the inside of the corner between said channel and said inner face.

4. A frame member of claim 2, in which there is a second screw-receiving bore at the inside of the corner between said channel and said inner face.

5. A corner of a framing section of a sectional door comprising frame members mitered together to form said corner, at least one of said frame members being a frame member according to claim 1.

6. A corner of a framing section of a sectional door which comprises a frame member of claim 1 mitered to a second frame member comprising a second tubular extrusion having a front face, an outer side face, a rear face and an inner side face, said second extrusion having a panel receiving channel indented into said inner side face adjacent said front face and an undercut receptor for a sealing bead located in said outer side face opposite to said channel, the front face of said second extrusion being narrower than the front face of said first extrusion and said miter being cut on an angle determined by the relative widths of said faces.

7. A framing section for an overhead door comprising top, bottom, and side frame members of which said top and side frame members are frame members according to claim 1, said top frame member being fastened to the tops of said side frame members in butt joints with the top frame member projecting beyond the tops of the side frame members and the side members sloping downwardly and outwardly to the ends of the bottom frame member.

8. A framing section of claim 7, in which said bottom frame member has a front-panel-receiving channel therein complementary with the corresponding channels in the top and side frame members and a front face which is narrower than the front face of the top and side frame members and said side member being fastened thereto on a miter cut on an angle determined by the relative widths of said faces and the slope of said side members, whereby the inner edges of the front faces of the side front frame members coincide with the inner edge of the front face of the bottom frame member at the miter.

9. A corner of claim 5, which both said frame members are according to claim 1 and which comprises sealing beads anchored in said receptors by complementarily shaped anchor strips, said beads being cut on the same angle as said miter, whereby the bead of the top frame member abuts the beads of the side members at said miter.

10. A corner of claim 6, in which a sealing bead is anchored in the undercut receptor of said first extrusion by means of a complementarily shaped anchor strip, said strip being cut away as needed to permit said bead to overlie the mitered part of said second extrusion.

11. A framing section of claim 7, in which sealing beads are anchored in said undercut receptors by means of complementarily shaped anchor strips and in which said strips of the sealing beads of said side frame members are cut away as needed to permit said beads to overlie the front of said top frame member and to abut the sealing bead anchored thereto.

12. A framing section of claim 8, in which sealing beads are anchored in said side frame members by means of complementarily shaped anchor strips which are cut off on said miter leaving said bead free to overlie the front face of said bottom frame member.

13. A sectional door comprising a frame member according to claim 1.

14. A sectional door comprising a corner according to claim 5.

15. An overhead door comprising a corner according to claim 6.

16. An overhead door comprising a corner according to claim 7.

17. An overhead door comprising a corner according to claim 8.

18. An overhead door comprising a corner according to claim 9.

19. An overhead door comprising a corner according to claim 10.

20. An overhead door comprising a framing section according to claim 11.

21. An overhead door comprising a framing section according to claim 12.

22. A sectional door, the framing sections of which comprise top, bottom, and side frame members formed of tubular extrusions hinged together by means of apposed transverse frame members which have complementary male and female hinge members adapted to slide one into the other and which are mitered to side frame members constructed according to claim 2, the side frame members which are mitered to the transverse member bearing the female hinge component having a plate member affixed thereto which has a lug that extends over the end of said female hinge component and inhibits lateral displacement of the male component therein, said plate overlying the portion of the outer side face from said protuberance to the rear face.

* * * * *